US010085097B2

(12) United States Patent
Vang et al.

(10) Patent No.: US 10,085,097 B2
(45) Date of Patent: Sep. 25, 2018

(54) HEARING ASSISTANCE DEVICE INCORPORATING SYSTEM IN PACKAGE MODULE

(71) Applicant: Starkey Laboratories, Inc., Eden Prairie, MN (US)

(72) Inventors: Ay Vang, Forest Lake, MN (US); Douglas F. Link, Plymouth, MN (US); Shawn Mahon, Howard Lake, MN (US); Kevin Lammi, Minneapolis, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 0 days.

(21) Appl. No.: 15/285,299

(22) Filed: Oct. 4, 2016

(65) Prior Publication Data

US 2018/0098162 A1 Apr. 5, 2018

(51) Int. Cl.
*H04R 25/00* (2006.01)

(52) U.S. Cl.
CPC ..... *H04R 25/60* (2013.01); *H04R 25/554* (2013.01)

(58) Field of Classification Search
CPC ..... B81B 3/0005; G06F 3/0346; H04R 25/60; B81C 1/00253
USPC ..... 257/704, 738, 777; 320/162; 361/679.56; 381/74, 312, 315, 321, 324; 429/124, 218.2, 322
See application file for complete search history.

(56) References Cited

U.S. PATENT DOCUMENTS

| | | | | |
|---|---|---|---|---|
| 5,825,631 | A | 10/1998 | Prchal | |
| 6,133,626 | A | 10/2000 | Hawke et al. | |
| 6,771,786 | B1 * | 8/2004 | Skindhøj | H04R 25/60 381/312 |
| 7,279,795 | B2 * | 10/2007 | Periaman | H01L 25/0657 257/772 |
| 7,842,542 | B2 | 11/2010 | Shim et al. | |
| 7,923,830 | B2 | 4/2011 | Pope et al. | |
| 8,369,553 | B2 | 2/2013 | Dumas et al. | |
| 8,659,113 | B2 | 2/2014 | Shim et al. | |
| 8,861,205 | B2 | 10/2014 | Lee | |
| 9,695,040 | B2 * | 7/2017 | Bolognia | H04R 1/04 |
| 2004/0141627 | A1 * | 7/2004 | Paczkowski | H05K 1/189 381/324 |

(Continued)

*Primary Examiner* — Gerald Gauthier
(74) *Attorney, Agent, or Firm* — Hollingsworth Davis, LLC

(57) ABSTRACT

A hearing assistance device comprises a system in package (SIP) disposed within an enclosure. The SIP module comprises a first substrate having a first surface and an opposing second surface, the first substrate supporting a first subsystem configured to perform a first function. A second substrate has a first surface and an opposing second surface, the second substrate supporting a second subsystem configured to perform a second function. The second surfaces face each other and at least one of the second surfaces supports one or more components. An interconnect layer is separate from and bonded to and between the first and second substrates. The interconnect layer comprises a window and a region peripheral to the window. The window is sized to accommodate the one or more components and the peripheral region comprising electrical pathways for electrically connecting the first subsystem and the second subsystem.

20 Claims, 8 Drawing Sheets

(56) References Cited

U.S. PATENT DOCUMENTS

| | | | | |
|---|---|---|---|---|
| 2007/0013052 | A1* | 1/2007 | Zhe | B81C 1/00309 257/704 |
| 2008/0001577 | A1* | 1/2008 | Sather | B60C 23/0411 320/162 |
| 2008/0192967 | A1* | 8/2008 | Chan | H01L 25/16 381/312 |
| 2010/0099020 | A1* | 4/2010 | Ouwerkerk | H01M 6/40 429/124 |
| 2010/0119941 | A1* | 5/2010 | Niessen | H01M 4/133 429/218.2 |
| 2010/0233548 | A1* | 9/2010 | Pijnenburg | H01M 4/13 429/322 |
| 2011/0157858 | A1 | 6/2011 | Jung et al. | |
| 2011/0188687 | A1* | 8/2011 | Song | H04R 25/00 381/321 |
| 2012/0212904 | A1* | 8/2012 | Fleming | H01B 1/18 361/679.56 |
| 2012/0267782 | A1* | 10/2012 | Chen | H01L 23/3128 257/738 |
| 2013/0001770 | A1 | 1/2013 | Liu | |
| 2013/0343564 | A1* | 12/2013 | Darlington | H04R 1/1083 381/74 |
| 2015/0086051 | A1 | 3/2015 | Link et al. | |
| 2015/0146899 | A1 | 5/2015 | Dzarmoski et al. | |
| 2015/0230035 | A1 | 8/2015 | Prchal et al. | |
| 2015/0264475 | A1* | 9/2015 | Link | H04R 3/00 381/312 |
| 2016/0021742 | A1 | 1/2016 | Johansson et al. | |
| 2016/0332863 | A1* | 11/2016 | Cheng | B81B 3/0005 |
| 2017/0060268 | A1* | 3/2017 | Chiu | G06F 3/0346 |
| 2018/0098162 | A1* | 4/2018 | Vang | H04R 25/554 |

* cited by examiner

*Figure 9A*
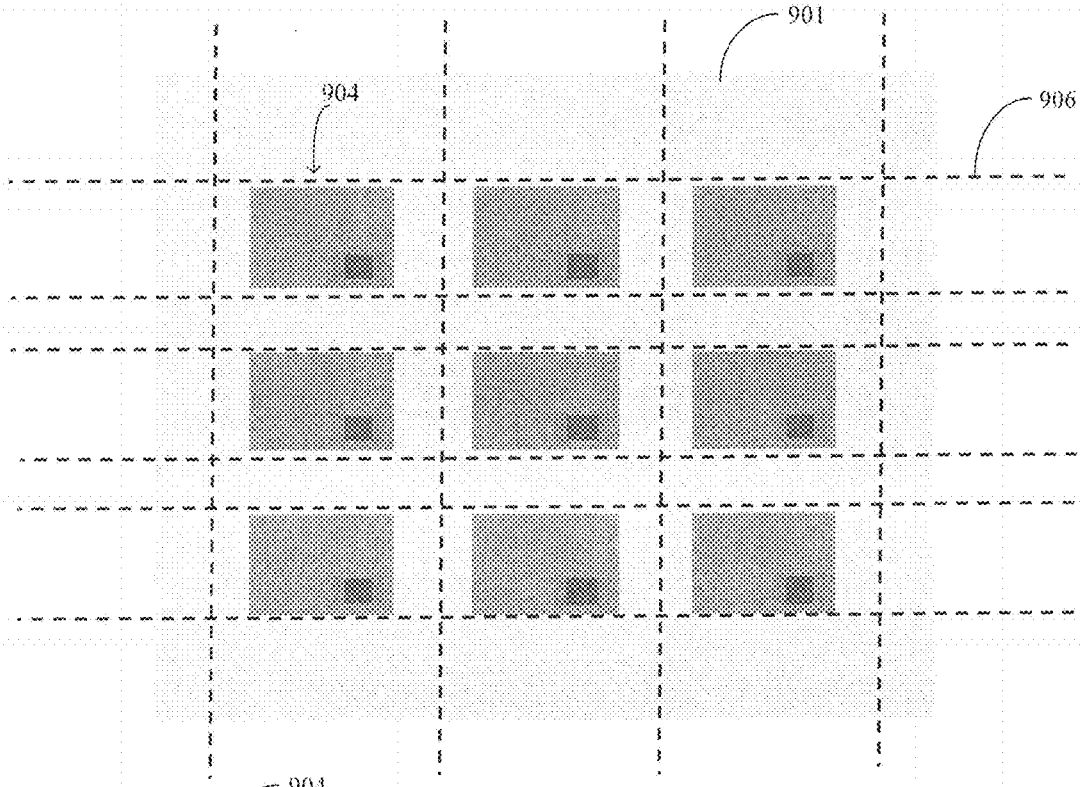
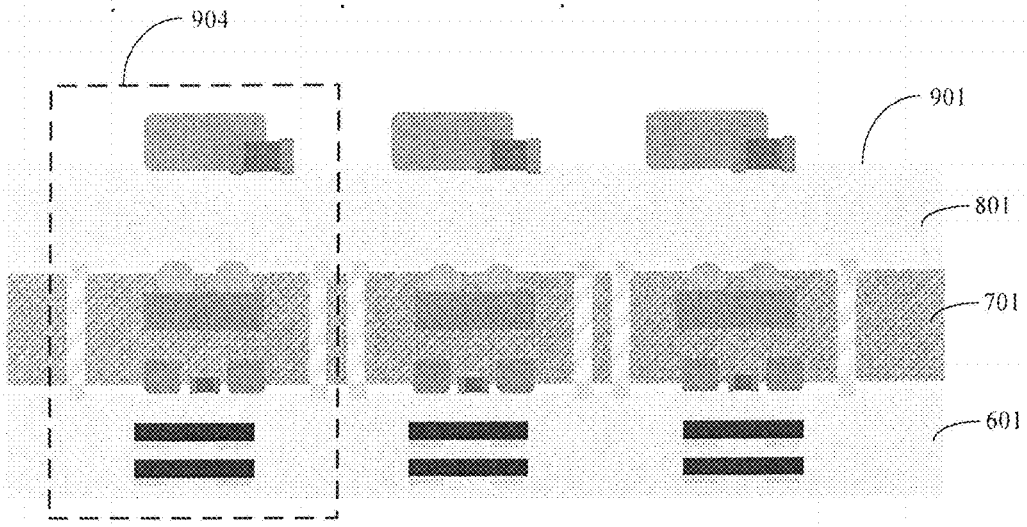
*Figure 9B*

HEARING ASSISTANCE DEVICE INCORPORATING SYSTEM IN PACKAGE MODULE

TECHNICAL FIELD

This application relates generally to hearing assistance devices and methods of making such devices.

BACKGROUND

Hearing aids are electronic instruments that compensate for hearing losses by amplifying sound. The electronic components of a hearing aid typically include a microphone for receiving ambient sound, an amplifier for amplifying the microphone signal, a speaker for converting the amplified microphone signal to sound for the wearer, and a battery for powering the components.

SUMMARY

Various embodiments are directed to a hearing assistance device adapted for use in or on a wearer. The hearing assistance device comprises an enclosure and a system in package (SIP) module disposed within the enclosure. The SIP module comprises a first substrate having a first surface and an opposing second surface. The first substrate supports a first subsystem configured to perform a first function. A second substrate having a first surface and an opposing second surface supports a second subsystem configured to perform a second function different from the first function. The second surfaces face each other and at least one of the second surfaces supports one or more components. An interconnect layer is separate from and bonded to and between the first and second substrates. The interconnect layer comprises a window and a region peripheral to the window. The window is sized to accommodate the one or more components and the peripheral region comprises electrical pathways for electrically connecting the first subsystem and the second subsystem.

Some embodiments are directed to a hearing assistance device adapted for use in or on a wearer comprising an enclosure and an SIP module disposed within the enclosure. The SIP module comprises a radio subsystem and a digital signal processor (DSP) subsystem arranged in a vertically stacked configuration. The SIP module comprises a first substrate having a first surface and an opposing second surface. The second surface of the first substrate supports the radio subsystem. A second substrate comprises a plurality of flexible layers and has a first surface and an opposing second surface. At least a DSP module of the DSP subsystem is embedded in the second substrate. The second surfaces face each other. An interconnect layer is separate from and bonded to and between the first and second substrates. The interconnect layer comprises a window and a region peripheral to the window. The window is sized to accommodate at least the radio subsystem and the peripheral region comprising electrical pathways for electrically connecting the radio subsystem and the DSP subsystem.

Other embodiments are directed to a hearing assistance device adapted for use in or on a wearer comprising an enclosure and a SIP module disposed within the enclosure. The SIP module comprises a first substrate having a first surface and an opposing second surface. The surface of the first substrate supports a radio subsystem. A second substrate comprises a plurality of flexible layers and has a first surface and an opposing second surface. A DSP subsystem is embedded in the second substrate. A non-volatile memory integrated circuit is embedded in the second substrate and separated from the DSP subsystem by at least one of the flexible layers. One or more surface mount components are coupled to the DSP subsystem and supported by the second surface of the second substrate. The second surfaces face each other. An interconnect layer is separate from and bonded to and between the first and second substrates. The interconnect layer comprises a window and a region peripheral to the window. The window is sized to accommodate the radio subsystem and the one or more surface mount components. The peripheral region comprises electrical pathways for electrically connecting the radio subsystem and the DSP subsystem.

The above summary is not intended to describe each disclosed embodiment or every implementation of the present disclosure. The figures and the detailed description below more particularly exemplify illustrative embodiments.

BRIEF DESCRIPTION OF THE DRAWINGS

Throughout the specification reference is made to the appended drawings wherein:

FIGS. 9A and 9B illustrate a multiplicity of SIP modules constructed from the substrates shown in FIGS. 6A-8B in accordance with various embodiments.

The figures are not necessarily to scale. Like numbers used in the figures refer to like components. However, it will be understood that the use of a number to refer to a component in a given figure is not intended to limit the component in another figure labeled with the same number.

DETAILED DESCRIPTION

Figure 1A:
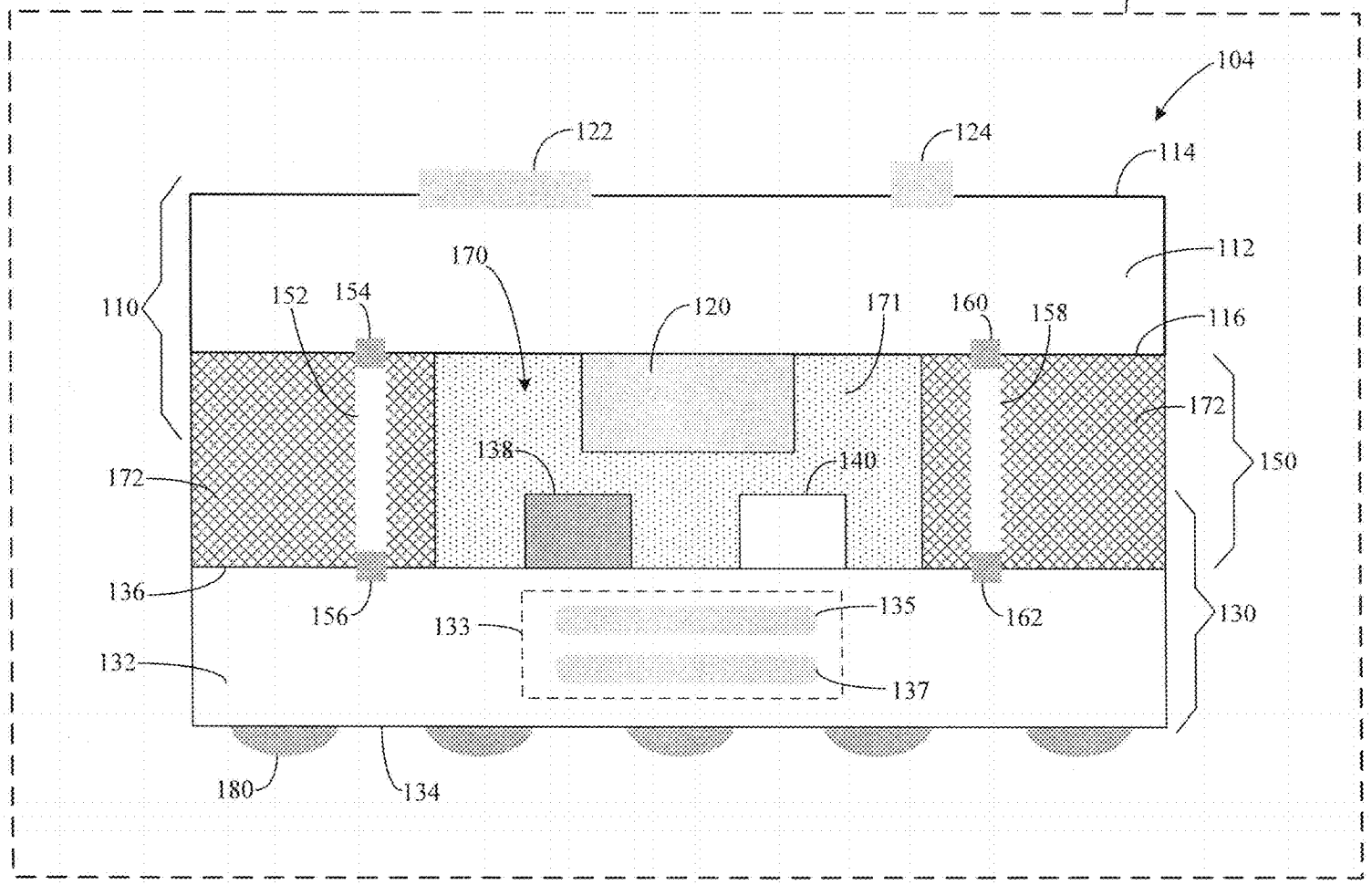
FIG. 1A is a cross-sectional view of a SIP module comprising a multiplicity of subsystems for use in a hearing assistance device in accordance with various embodiments.

It is understood that the embodiments described herein may be used with any hearing device without departing from the scope of this disclosure. The devices depicted in the figures are intended to demonstrate the subject matter, but not in a limited, exhaustive, or exclusive sense. It is also understood that the present subject matter can be used with a device designed for use in or on the right ear or the left ear or both ears of the wearer.

Hearing assistance devices, such as hearing aids and hearables (e.g., wearable earphones), typically include an enclosure, such as a housing or shell, within which internal components are disposed. Typical internal components of a hearing assistance device can include a signal processor, memory, power management circuitry, one or more communication devices, one or more antennas, one or more microphones, and a receiver/speaker, for example. The housing or shell of a hearing assistance device has a size limitation based on the application. Specifically, devices that include an in-the-ear shell or an on-the-ear shell are constrained by the geometry of the inner or outer ear of the wearer. More advanced hearing assistance devices can incorporate a long-range communication device, such as a Bluetooth® transceiver, space for which must be allocated within the shell of the device. As hearing assistance device technology continues to advance, a greater number of electronic components will be required to provide enhanced functionality, which further complicates the packaging strategy within the shell of the device.

Embodiments of the disclosure are directed to a hearing assistance device which incorporates a multiplicity of electronic subsystems configured in the form of a system in package (SIP) module. The term SIP is often used interchangeably in industry with the term package-on-package (PoP). It is understood that the term SIP module as used herein also refers to a PoP module or a combined SIP/PoP module. According to various embodiments, a hearing assistance device incorporates a multiplicity of integrated circuits or chips arranged in multiple layers as a SIP module. For example, a multiplicity of integrated circuits or chips can be arranged in a vertically stacked configuration as a SIP module.

Embodiments of the disclosure are directed to a SIP module adapted for use in various types of hearing devices, including hearables, hearing assistance devices, and/or hearing aids, including but not limited to, behind-the-ear (BTE), in-the-ear (ITE), in-the-canal (ITC), receiver-in-canal (RIC), receiver-in-the-ear (RITE) or completely-in-the-canal (CIC) type hearing devices. It is understood that behind-the-ear type hearing devices may include devices that reside substantially behind the ear or over the ear.

According to various embodiments, a SIP module adapted for incorporation in a hearing assistance device includes at least two vertically stacked subsystems, each of which comprises at least one integrated circuit (IC). In some embodiments, the IC or ICs of one of the vertically stacked subsystems of the SIP module is/are embedded into a flexible circuit substrate. The IC or ICs of other vertically stacked subsystems of the SIP module can be supported by a rigid substrate or a flexible circuit substrate. In other embodiments, each of the vertically stacked subsystems can include one or more ICs embedded in a flexible circuit substrate.

Embodiments of a SIP module incorporate an interconnect layer disposed between the vertically stacked subsystems. The interconnect layer comprises a discrete substrate having a window and a region peripheral to the window. The window of the interconnect layer is sized to accommodate one or more components mounted to or extending from internal surfaces of the vertically stacked subsystems. The peripheral region of the interconnect layer incorporates electrical pathways for electrically connecting the vertically stacked subsystems. Electrical contacts on an exterior surface or surfaces of the SIP module serve as input/output pads for establishing electrical connection with other components of the hearing assistance device, typically via a mother flexible circuit disposed within the shell.

A SIP module that incorporates a multiplicity of vertically stacked subsystems each separated by a windowed interconnect layer provides for integration of a greater number of electronic components within the constrained space of an in- or on-the-ear hearing assistance device as compared to conventional packaging techniques. For example, a SIP module implemented in accordance with the present disclosure can accommodate four integrated circuits or dies within the space of two ICs or dies using conventional packaging techniques.

FIG. 1A is a cross-sectional view of a SIP module comprising a multiplicity of subsystems for use in a hearing assistance device in accordance with various embodiments. FIG. 1A shows a SIP module 104 incorporated within a hearing assistance device 102. The SIP module 104 includes a first subsystem 110 and a second subsystem 130. The first subsystem 110 is a fully functional system that performs a first function, and the second subsystem 130 is a fully functional system that performs a second function. The first function performed by the first subsystem 110 is preferably different from the second function performed by the second subsystem 130. The first function, for example, may be a communication function, and the second function may be a signal processing function or a power management function. Other functions performed by the first and second subsystems 110 and 130 are contemplated, such as a biometric sensing function.

In the embodiment shown in FIG. 1A, the first subsystem 110 includes a first substrate 112 having a first surface 114 and an opposing second surface 116. The first substrate 112 can be a rigid substrate or a flexible substrate with layers that interconnect via electrically conductive pathways or traces. For example, the first substrate 112 can be a printed circuit board (PCB) formed from a rigid material such as bismaleimide-triazine (BT) resin, FR4 (e.g., glass-reinforced epoxy laminate) or other type of rigid PCB material.

The first surface 114 of the first substrate 112 supports one or more components 122 and 124, which may be SMT (surface mount technology) components. Although two components 122 and 124 are shown populating the first surface 114 for illustrative purposes, it is understood that any number of components may be supported by the first surface 114 of the first substrate 112. The second surface 116 of the first substrate 112 supports one or more components 120. The one or more components 120 can include an SMT component, a flip-chip, a chip scale package-on-board (CSPOB) module, or a mix of these components/modules.

The second subsystem 130 includes a second substrate 132 having a first surface 134 and an opposing second surface 136. In the vertically stacked structure shown in FIG. 1A, the second surface 136 of the second substrate 132 faces (e.g., is substantially parallel to) the second surface 116 of the first substrate 112 in a spaced-apart relationship. The second surface 136 of the second substrate 132 supports one or more components 138 and 140 (two components are shown for illustrative purposes), which may include any mix of SMT components, a flip-chip, and a CSPOB module. According to various embodiments, the second substrate 132 constitutes a flexible circuit substrate into which one or more components are embedded. The flexible circuit substrate may be constructed from films of a polyimide material. In some embodiments, the second substrate 132 constitutes a flexible circuit board into which several integrated chips 135 and 137 of a module 133 are embedded vertically to define a wafer and board level device embedded package or WABE.

The first surface 134 of the second substrate 132 includes a multiplicity of electrical contacts 180. The electrical contacts 180 serve as user input/output (I/O) pads for the SIP module 104. For example, the electrical contacts 180 connect the SIP module 104 with other components of the hearing assistance device 102, such as a battery, microphones, receiver, transceiver, and other components. The electrical contacts 180 may constitute electrically conductive traces, solder bumps or balls (e.g., a ball grid array or BGA), or other type of electrical contact. For example, the electrical contacts 180 may be configured to allow for either BGA style gang reflow onto a mother flex circuit (see, e.g., FIG. 5) or individual hand wire soldering methods.

The first and second subsystems 110 and 130 define a vertically stacked SIP structure, with each subsystem 110, 130 supporting components that define a fully functioning system. An interconnect layer 150 is disposed between the first and second subsystems 110 and 130. The interconnect layer 150 is a discrete layer that separates the first and second subsystems 110 and 130. The interconnect layer 150 can constitute a substrate formed from a rigid material such as BT resin or FR4. In some embodiments the interconnect layer 150 can constitute a flexible substrate, such as one formed from polyimide or another suitable flexible substrate material. The interconnect layer 150 includes a window 170 (e.g., an aperture or void) and a solid region 172 peripheral to the window 170. The window 170 is sized to accommodate the components 120, 138, 140 supported by the spaced-apart and opposing second surfaces 116 and 136 of the first and second substrates 112 and 132. The window 170 is preferably filled with filler material 171, such as an adhesive.

The window 170 is shown as a void in the shape of a square or a rectangle in FIG. 1A and other figures for purposes of illustration. It is understood that the window 170 can have a different shape, such as a curved shape, and need not be centrally located within the interconnect layer 150. Moreover, the window 170 need not be a single window, but may include a multiplicity of apertures or voids that accommodate individual components or groups of components. Additional details concerning the interconnect layer 150 are disclosed in commonly owned U.S. Pat. No. 5,825,631, which is incorporated herein by reference.

Figure 2:
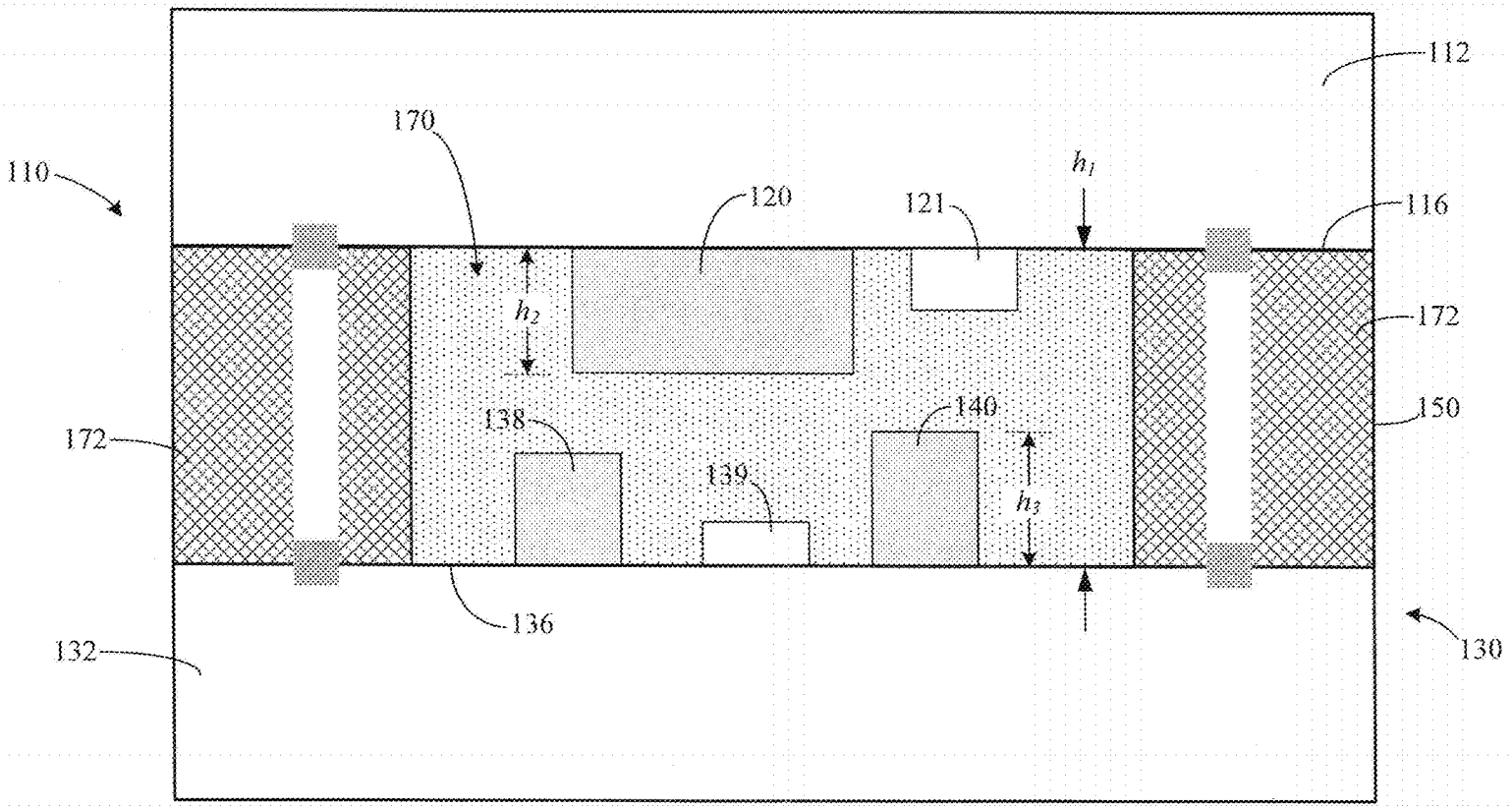
FIG. 2 is a cross-sectional view showing details of a windowed interconnect layer of the SIP modules shown in FIGS. 1A and 1B in accordance with various embodiments.

Referring now to FIG. 2, the vertical height of the window 170 of the interconnect layer 150 is sized to accommodate the vertical height of the various electronic components populating the opposing second surfaces 116 and 136 of the first and second substrates 112 and 132. The vertical height of the window 170 is shown as height $h_1$, which corresponds to the thickness of the interconnect layer 150. In general, the thickness of the interconnect layer 150 is selected to provide the thinnest possible package while maintaining adequate clearance between the electronic and electrical components attached to the opposing second surfaces 116 and 136 of the first and second substrates 112 and 132. Accordingly, the height, $h_1$, of the window 170 is sized to provide clearance for electronic components populating the opposing second surfaces 116 and 136 of the first and second substrates 112 and 132.

The largest component 120 (in terms of height) supported by the second surface 116 of the first substrate 112 has a height of $h_2$. The largest component 140 (in terms of height) supported by the second surface 136 of the second substrate 132 has a height of $h_3$. In general, the height, $h_1$, of the window 170 is preferably equal to or greater than the combined height, $h_2+h_3$, of the largest components 120 and 140 on the two opposing second surfaces 116 and 132. Depending on the placement of the components on the two opposing second surfaces 116 and 132, the height, $h_1$, of the window 170 can be less than the combined height, $h_2+h_3$, of the largest components 120 and 140. For example, the two largest components 120 and 140 can be offset laterally from one another such that these components interleave one another, which allows for the height, $h_1$, of the window 170 to be less than the combined height, $h_2+h_3$, of the largest components 120 and 140.

Returning to FIG. 1A, the peripheral region 172 of the interconnect layer 150 includes electrical pathways 152 and 158 for electrically connecting the first subsystem 110 and the second subsystem 130. The electrical pathways 152 and 158 are vertical interconnects (e.g., electrically conductive vias) that extend through the peripheral region 172 and terminate at interconnect pads 154, 156 and 160, 162, respectively. The vertical interconnects 152 and 158 provide the required electrical routing paths to connect the first and second subsystems 110 and 130. For simplicity of explanation, two vertical interconnects 152 and 158 are shown in the cross-sectional view of FIG. 1A (and other figures). It is understood that more than two vertical interconnects can be incorporated in the cross-section of the peripheral region 172 shown in FIG. 1A. The vertical interconnects 152 and 158 can be formed as vias lined with a conductive metal (e.g., Au, Ag, or Cu) or a conductive paste. In FIG. 1A and other figures, the conductive traces that provide electrical connection between the various components and the subsystems 110 and 130 of the SIP module 104 are implicit in the figures, and are omitted for purposes of clarity.

Figure 1B:
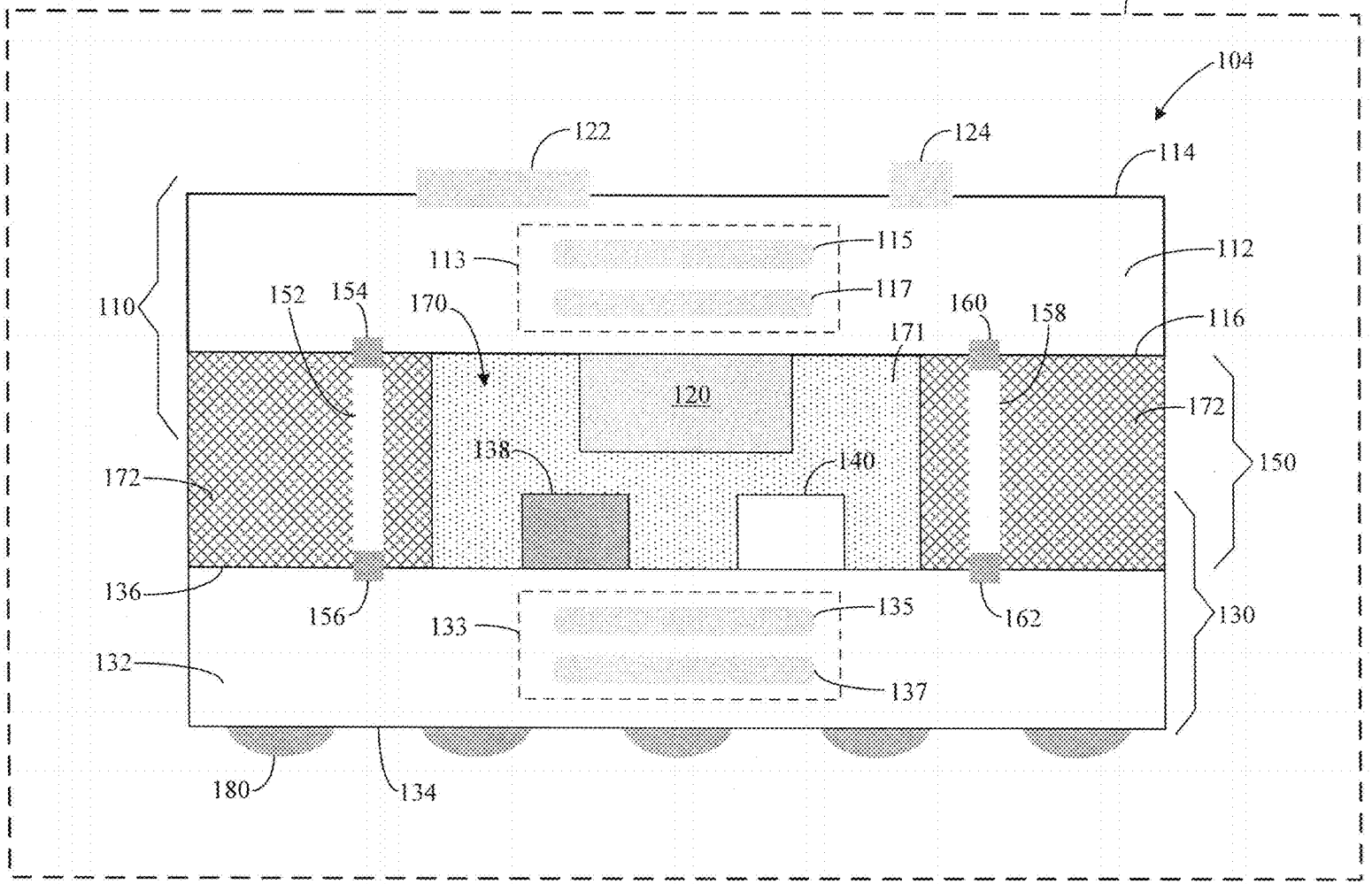
FIG. 1B is a cross-sectional view of a SIP module comprising two double embedded subsystems for use in a hearing assistance device in accordance with various embodiments.

FIG. 1B is a cross-sectional view of a SIP module comprising two double embedded subsystems for use in a hearing assistance device in accordance with various embodiments. The SIP module 104 shown in FIG. 1B is similar to that shown in FIG. 1A, but incorporates two double embedded modules 113 and 133 in the first and second subsystems 110 and 130. The double embedded module 113 includes two integrated circuits 115 and 117. The double embedded module 133 includes two integrated circuits 135 and 137. The integrated circuits 115, 117, 135, and 137 can be any of the integrated circuits or components/sensors described herein.

Figure 3:
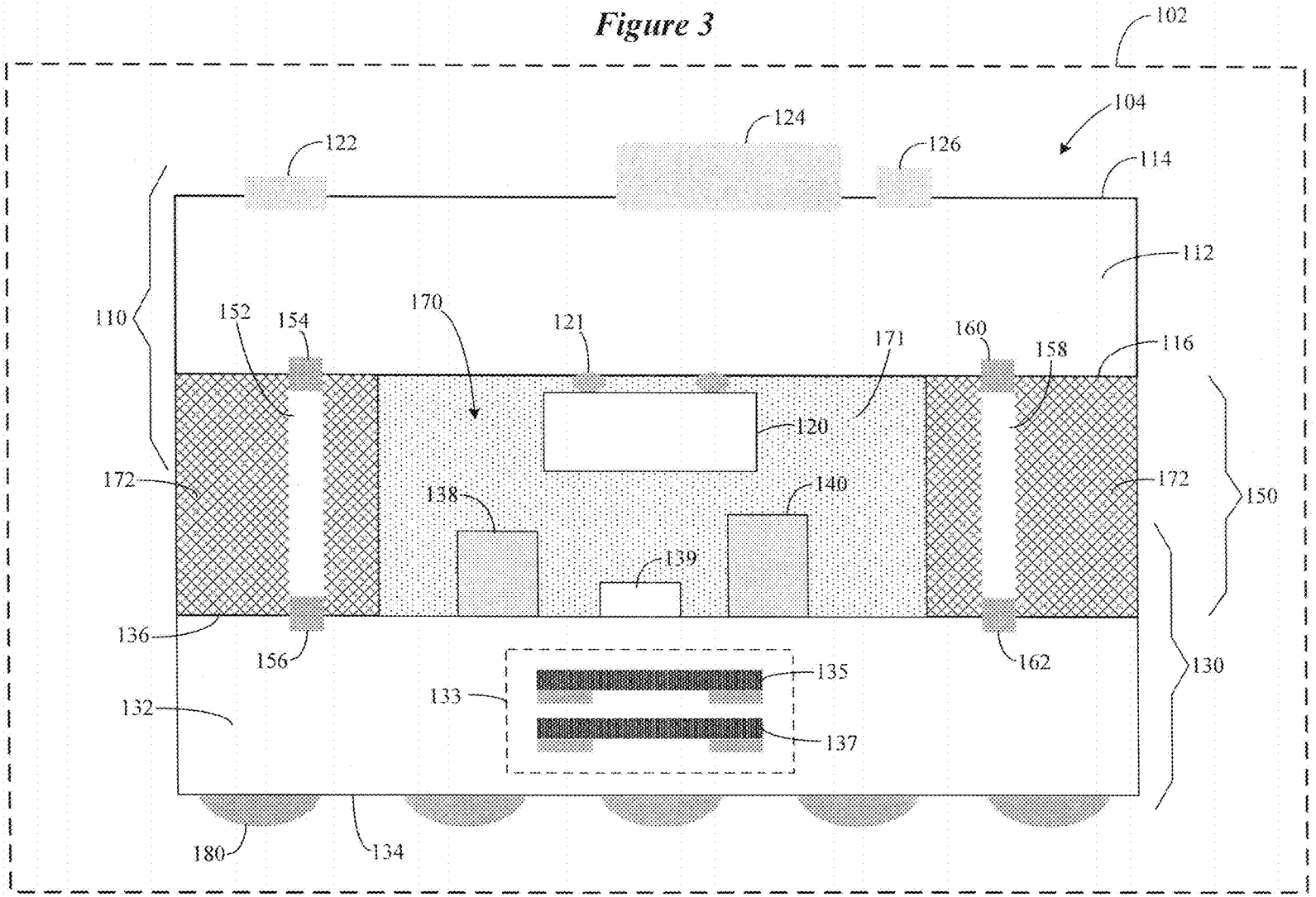
FIG. 3 is a cross-sectional view of a double embedded SIP module comprising a multiplicity of subsystems for use in a hearing assistance device in accordance with various embodiments.

FIG. 3 is a cross-sectional view of a SIP module comprising a multiplicity of subsystems for use in a hearing assistance device in accordance with various embodiments. The SIP module 104 shown in FIG. 3 includes a first subsystem 110 electrically coupled to a second subsystem 130 via a multiplicity of vertical interconnects 152 and 158 extending through an interconnect layer 150 disposed between the first and second subsystems 110 and 130. According to some embodiments, the first subsystem 110 constitutes a communication subsystem, and the second subsystem 130 constitutes a DSP (digital signal processing) subsystem. In other embodiments, the first subsystem 110 constitutes a communication subsystem, and the second subsystem 130 constitutes a power management subsystem. In further embodiments, the first subsystem 110 constitutes a biometric sensor subsystem, and the second subsystem 130 constitutes a processor-based subsystem. It is understood that the functions performed by the first and second subsystems 110 and 130 can differ from those described herein.

In the following discussion, the first subsystem 110 is described as a communication subsystem and the second subsystem 130 is described as a DSP subsystem. The communication subsystem 110 comprises a first substrate 112 having a first surface 114 and an opposing second surface 116. The first surface 114 of the first substrate 112 supports various SMT components 124 and 126 (two components are shown for illustrative purposes) and an antenna connection pad 122. The second surface 116 of the first substrate 112 supports a communication device 120, which is preferably packaged in the form of a flip-chip or a CSPOB module. According to some embodiments, the communication device 120 comprises a 2.4 GHz radio subsystem packaged as a flip-chip or a CSPOB module. A suitable radio subsystem is a 2.4 GHz Bluetooth® Low Energy (BLE) radio subsystem. The representative SMT components 124 and 126 shown in FIG. 3 represent a crystal oscillator, inductors, capacitors, and other components required for full radio functionality. The communication device 120 can be attached to traces on the second surface 116 of the first substrate 112 flip-chip style via solder bumps 121. In some embodiments, the communication device 120 comprises a 900 MHz radio subsystem. In other embodiments, the communication device 120 comprises a near-field magnetic induction (NFMI) device. In further embodiments, the communication device 120 can be substituted for a sensor, such as a physiologic, motion, light, temperature, moisture or magnetic sensor, for example. Useful biometric sensors can include one or more of an oxygen saturation sensor (e.g., pulse oximeter or plethysmography sensor), a heart rate sensor, and an electroencephalogram sensor, for example.

According to various embodiments, the second subsystem 130 includes a flexible circuit substrate 132 which supports a double embedded DSP module 133 comprising a DSP IC 137 and a non-volatile memory IC 135. Although not shown, conductive traces electrically connect the DSP IC 137 and the memory IC 135. The DSP IC 137 and the memory IC 135 are both embedded into the flexible circuit substrate 132, one directly atop the other, preferably in the form of a WABE module. In accordance with other embodiments, the second subsystem 130 can include a double embedded module with ICs that provide different functionality. For example, the double embedded module 133 can include an analog ASIC 135 (primarily analog but may include some digital elements) and a digital ASIC 137 (primarily digital but may include some analog elements). In further embodiments, the module 133 may be a double embedded or a single embedded module which includes a power management IC.

An interconnect layer 150 is disposed between the communication subsystem 110 and the DSP subsystem 130. The interconnect layer 150 is of a form and construction previously described. The window 170 of the interconnect layer 150 is sized to accommodate the communication device 120 (e.g., radio IC) and the passive SMT components 138, 139, and 140 (e.g., capacitor, inductors, resistors) coupled to the DSP module 133. The thickness of the interconnect layer 150 is selected to provide the thinnest possible package while maintaining adequate clearance between the communication device 120 and the passive SMT components 138, 139, and 140.

Figure 4:
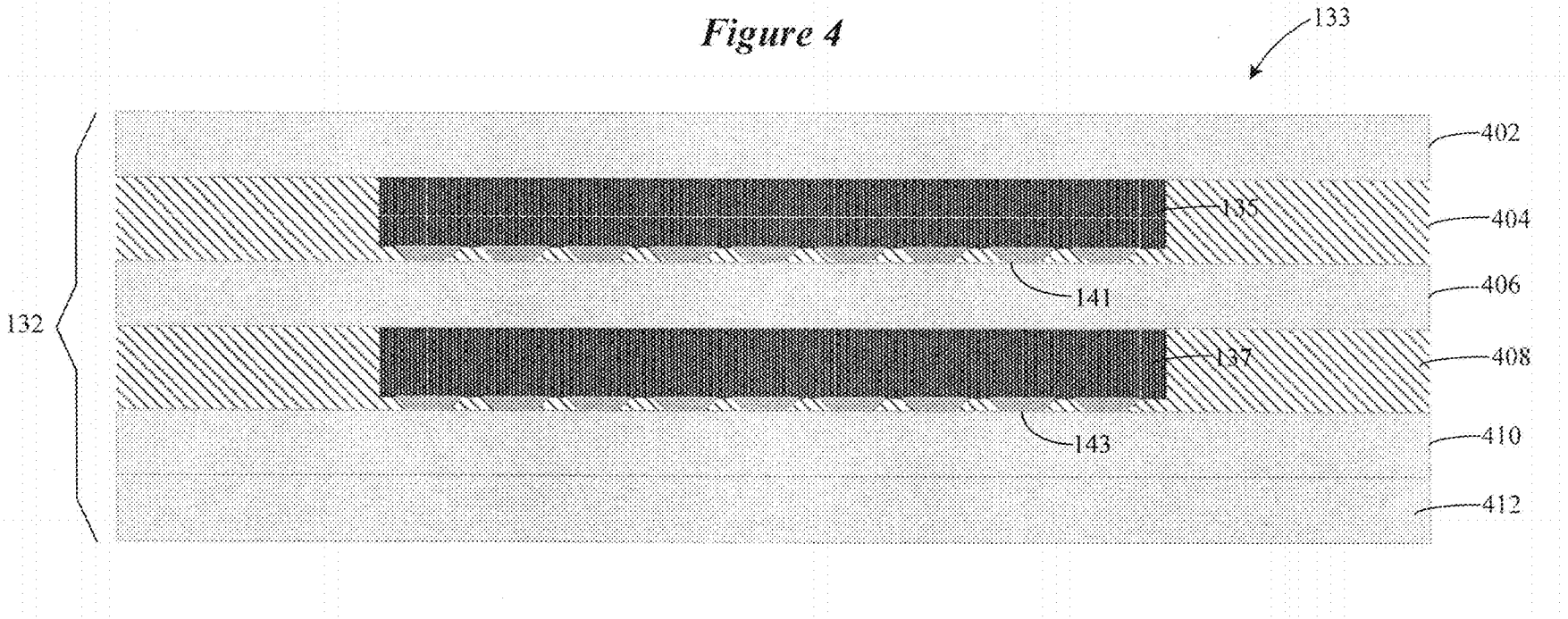
FIG. 4 illustrates details of the double embedded module shown in FIG. 3 in accordance with various embodiments.

FIG. 4 illustrates details of the double embedded module 133 shown in FIG. 3 in accordance with various embodiments. In the embodiment shown in FIG. 4, the flexible circuit substrate 132 includes a multiplicity of flexible films within which two ICs 135 and 137 are embedded. The two ICs 135 and 137 can be of a type previously described. For example, IC 135 can be a non-volatile memory IC, and IC 137 can be a DSP IC.

The first IC 135 is disposed between organic layers 402 and 406, with the first IC 135 embedded within a flexible core film 404. The first IC 135 includes solder bumps 141 that connect with corresponding traces (not shown) of the organic layer 406. The second IC 137 is disposed between organic layers 406 and 410, with the second IC 137 embedded within a flexible core film 408. The second IC 137 includes solder bumps 143 that connect with corresponding traces (not shown) of the organic layer 410. One or more additional flexible layers 412 may be provided adjacent the organic layer 410 to rigidize the flexible substrate 132. It is noted that one or more additional flexible layers can be provided adjacent the organic layer 402 to further rigidize the flexible substrate 132.

According to some embodiments, the flexible layers 402, 406, 410, and 412 can constitute a single clad film formed from polyimide, and have a thickness of about 15 μm. The flexible layers 404 and 408 can constitute a core double clad film formed from polyimide, and have a thickness of about 50 μm. Each of the ICs 135 and 137 can have a thickness of about 85 μm.

Figure 5:
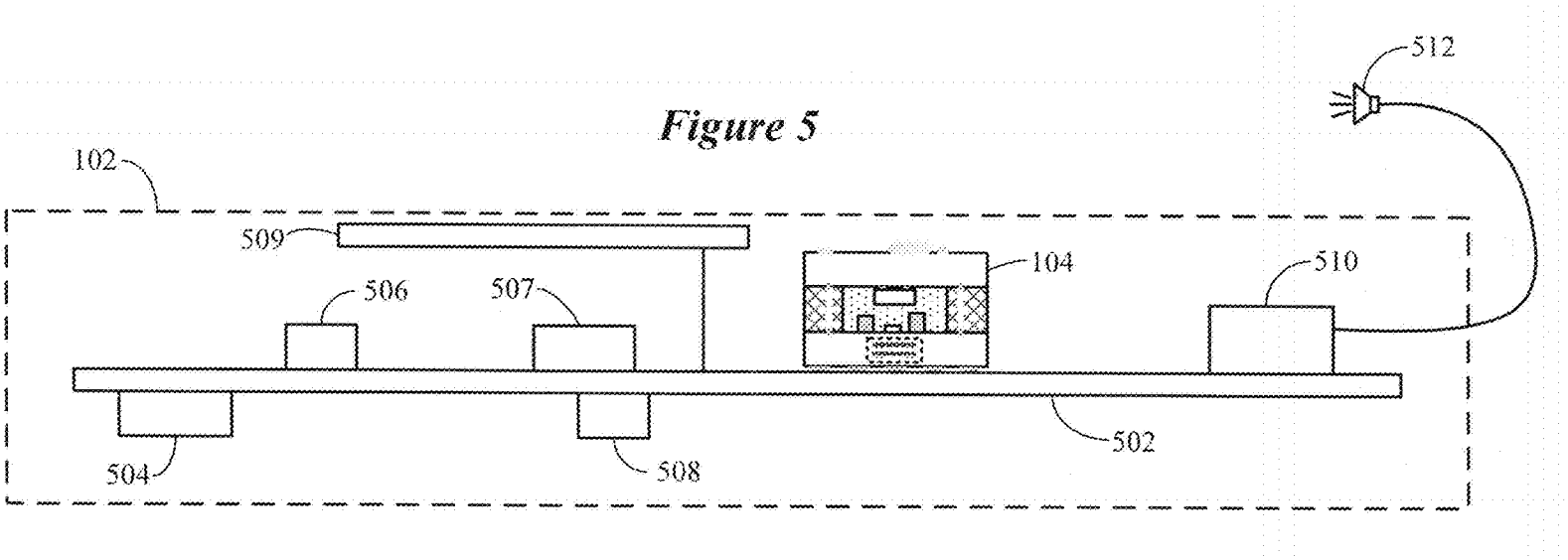
FIG. 5 illustrates a SIP module incorporated in a representative hearing assistance device in accordance with various embodiments.

FIG. 5 illustrates a SIP module 104 incorporated in a representative hearing assistance device 102 in accordance with various embodiments. The hearing assistance device 102 shown in FIG. 5 includes a SIP module 104 of a type previously described. The SIP module 104 is electrically connected to a mother flexible circuit 502 to which other components of the hearing assistance device 102 are electrically connected. A battery 504 is electrically connected to the mother flexible circuit 502 and provides power to the various components of the hearing assistance device 102. One or more microphones 506 are electrically connected to the mother flexible circuit 502, which provides electrical communication between the microphones 506 and the SIP module 104. One or more user switches 508 (e.g., on/off, volume, mic directional settings) are electrically coupled to the SIP module 104 via the flexible mother circuit 502.

An audio output device 510 is electrically connected to the SIP module 104 via the flexible mother circuit 502. In some embodiments, the audio output device 510 comprises a speaker (coupled to an amplifier). In other embodiments, the audio output device 510 comprises an amplifier coupled to an external receiver 512 adapted for positioning within an ear of a user. The hearing assistance device 102 may incorporate a communication device 507 coupled to the flexible mother circuit 502 and to an antenna 509 directly or indirectly via the flexible mother circuit 502. The communication device 507 can be a Bluetooth® transceiver, such as a BLE (Bluetooth® low energy) transceiver or other transceiver (e.g., an IEEE 802.11 compliant device). It is noted that, in some embodiments, one or both of the communication device 507 and the audio output device 510 can be incorporated in the SIP module 104.

A SIP module implemented in accordance with various embodiments of the disclosure includes a fully functional first subsystem, a fully functional second subsystem, and an interconnect layer disposed between the first and second subsystems. During SIP module fabrication, the three-part SIP module configuration advantageously allows for individual testing of the first and second subsystems prior to constructing the SIP modules. Individual testing of the first and second subsystems allows for identification of defective subsystems prior to constructing the SIP modules, which avoids wasteful discarding of a properly operating subsystem if integrated with a defective subsystem.

Figure 8A:
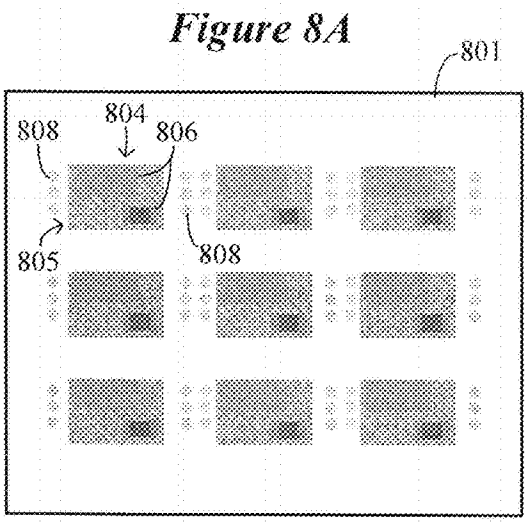
FIGS. 8A and 8B illustrate a substrate comprising a multiplicity of subsystems each including a module configured to perform one or more functions in accordance with various embodiments.
Figure 8B:
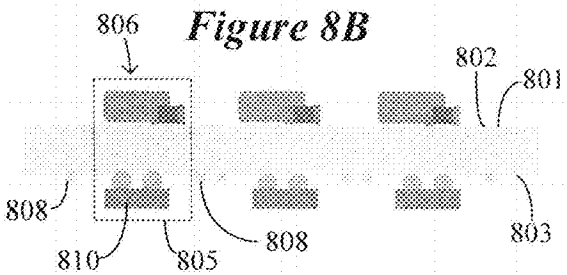
Figure 7A:
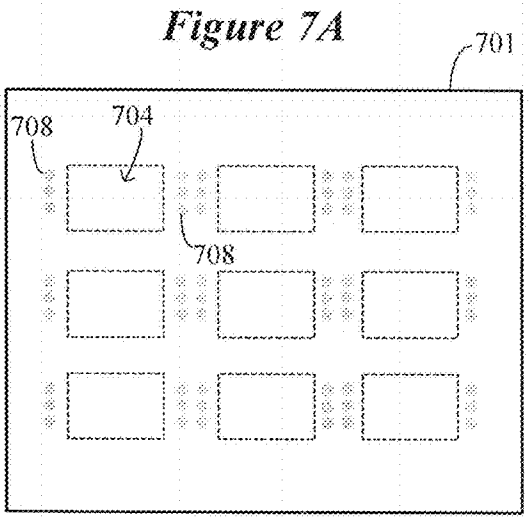
FIGS. 7A and 7B illustrate a substrate comprising a multiplicity of interconnect layer regions in accordance with various embodiments.
Figure 7B:
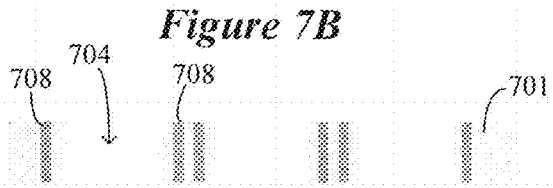
Figure 6A:
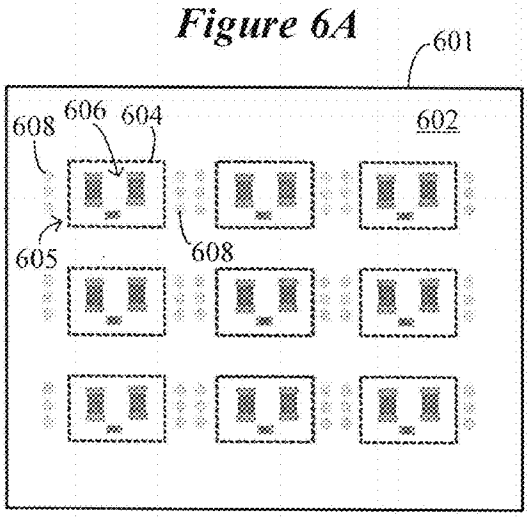
FIGS. 6A and 6B illustrate a substrate comprising a multiplicity of subsystems each including a double embedded module in accordance with various embodiments.
Figure 6B:
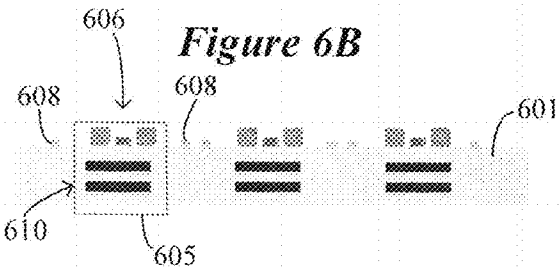

Methods of fabricating a SIP module in accordance with various embodiments will now be described with reference to FIGS. 6A-9B. FIGS. 6A and 6B illustrate a substrate 601 comprising a multiplicity of subsystems each including a double embedded module of a type previously described. For purposes of illustration, the substrate 601 will be described as a DSP subassembly substrate. FIGS. 7A and 7B illustrate a substrate 701 comprising a multiplicity of interconnect layer regions of a type previously described. FIGS. 8A and 8B illustrate a substrate 801 comprising a multiplicity of subsystems each including a module of a type previously described. For purposes of illustration, the substrate 801 will be described as a radio subassembly substrate. FIGS. 9A and 9B illustrate a multiplicity of SIP modules constructed from the substrates 601, 701, and 801 shown in FIGS. 6A-8B. It is understood that the subsystem substrates 601 and 801 can be fabricated to include modules other than DSP and radio modules (e.g., power management modules, NFMI modules, biometric sensor modules).

According to various embodiments, and with reference to FIGS. 6A and 6B, a flexible circuit substrate 602 is shown to include an arrangement (e.g., a matrix of rows and columns) of circuit regions 604 each containing a DSP subsystem 605 embedded into the flexible circuit substrate 602 preferably using WABE technology. The DSP subsystem 605 includes a double embedded DSP module 610 comprising one DSP die and one non-volatile memory die stacked above each other and embedded into the flexible circuit substrate 602. The top surface of the flexible circuit substrate 602 includes solder pads to which SMT chip components 606 are placed using a pick-and-place technique. Each of the fully functional DSP modules 610 can be tested prior to additional fabrication processing. Defective DSP modules 610 can be identified and excluded from further processing.

For purposes of simplicity, FIGS. 6A-8B show substrates 601, 701, 801 comprising nine circuit regions. In actual fabrication, each substrate 601, 701, 801 typically includes dozens or hundreds of circuit regions for fabricating a corresponding number of subsystems/SIP modules. For example, the flexible circuit substrate 602 can be fabricated in approximately 50 mm×150 mm strips with approximately 150 circuits per strip, depending on the actual circuit size. The top surface of the flexible circuit substrate 602 includes solder pads to which approximately 24 SMT chip components 606 are populated. Provided on the same surface of the flexible circuit substrate 602 and situated adjacent to the SMT component pads are several solder pads 608. The solder pads 608 of the flexible circuit substrate 602 electrically connect with corresponding vertical interconnects 708 of the interconnect layer/substrate 701 when the interconnect substrate 701 is registered with, and bonded to, the flexible circuit substrate 602. As was discussed previously, the vertical interconnect substrate 701 provides the required electrical routing paths to connect the DSP subsystems 605 with their corresponding radio subsystems 805.

The radio subassembly substrate 801 shown in FIGS. 8A and 8B includes a number of circuit regions 804 within which a 2.4 GHz radio module 805 is fabricated using flip-chip technology and a pick-and-place technique. As is shown in FIG. 8B, a radio IC 810 is attached flip-chip style on a second surface 803 of the substrate 801. Also provided on the second surface 803 adjacent the radio IC 810 are solder pads 808 for establishing connections with the vertical interconnects 708 of the interconnect substrate 701. A crystal oscillator, inductors, and capacitors 806 required for full radio functionality are mounted to the first surface 802 of the substrate 801 using SMT methods. Each of the fully functional radio subsystems 805 can be tested prior to additional fabrication processing. Defective radio subsystems 805 can be identified and excluded from further processing.

As was previously discussed, the thickness of the vertical interconnect substrate 701 is selected to provide the thinnest possible package while maintaining adequate clearance between the radio die 810 of the radio subassembly substrate 801 and the passive components 606 attached to the flexible circuit substrate 602 of the DSP subassembly substrate 601. An adhesive material can be used within the window 704 of the interconnect substrate 701 between the DSP subassembly substrate 601 and the radio subassembly substrate 801. The adhesive material can serve as a mold compound and an adhesive to increase robustness of the SIP modules 904. The adhesive can be applied in several fashions. For example, one approach is to use the adhesive as a semi-cured adhesive that is applied to the radio IC 810 at the wafer level. This semi-cured adhesive then flows during lamination or reflow and seals the space 704 between the DSP and radio subassembly substrates 601 and 801.

It is noted that vertical interconnect pad connection material can be a WABE conductive paste or a lead-free solder paste. If a WABE conductive paste is used, an adhesive is pre-applied to the radio IC 810 and the radio IC components 806 are populated post-lamination to the first surface 802 of the substrate 801. If solder is used, then the radio IC components 806 can be populated on the first surface 802 of the substrate 801 prior to assembly of the SIP modules 904, and the adhesive material is dispensed post-SIP module assembly.

FIGS. 9A and 9B illustrate a multiplicity of fully functional SIP modules 904 constructed from the substrates 601, 701, and 801 shown in FIGS. 6A-8B. FIG. 9A shows saw lines (dashed lines) 906 superimposed over the SIP module composite substrate 901. Individual SIP modules 904 are singulated by cutting through the saw lines. The singulated SIP modules 904 may then be incorporated into hearing assistance devices or other hearables.

This document discloses numerous embodiments, including but not limited to the following:

Item 1 is a hearing assistance device adapted for use in or on a wearer, the hearing assistance device comprising:

an enclosure; and a system in package (SIP) module disposed within the enclosure, the SIP module comprising:

a first substrate having a first surface and an opposing second surface, the first substrate supporting a first subsystem configured to perform a first function;

a second substrate having a first surface and an opposing second surface, the second substrate supporting a second subsystem configured to perform a second function different from the first function;

the second surfaces facing each other and at least one of the second surfaces supporting one or more components; and an interconnect layer separate from and bonded to and between the first and second substrates, the interconnect layer comprising a window and a region peripheral to the window, the window sized to accommodate the one or more components and the peripheral region comprising electrical pathways for electrically connecting the first subsystem and the second subsystem.

Item 2 is the hearing assistance device of item 1, wherein the first substrate, the interconnect layer, and the second substrate define a vertically stacked structure.

Item 3 is the hearing assistance device of item 1, wherein the window is sized to provide clearance for components supported on one or both of the second surfaces of the first and second substrates.

Item 4 is the hearing assistance device of item 1, wherein each of the second surfaces supports one or more components.

Item 5 is the hearing assistance device of item 1, wherein: one of the first surfaces supports one or more components; and the other of the first surfaces comprises a plurality of spaced-apart electrical contacts for communicating with and powering the SIP module.

Item 6 is the hearing assistance device of item 1, wherein at least one of the first and second substrates comprises a flexible substrate.

Item 7 is the hearing assistance device of item 1, wherein: the first substrate comprises a rigid substrate; and the second substrate comprises a flexible substrate.

Item 8 is the hearing assistance device of item 1, wherein: the second substrate comprises a plurality of flexible substrate layers;

the second subsystem comprises a first integrated circuit (IC) and a second IC; and the first and second ICs are separated by at least one of the flexible substrate layers.

Item 9 is the hearing assistance device of item 8, wherein: the first subsystem comprises a communications device;

the first IC of the second subsystem comprises a processor IC; and the second IC of the second subsystem comprises a memory IC.

Item 10 is the hearing assistance device of item 1, wherein: the first subsystem comprises a radio, a near-field magnetic induction (NFMI) device or one or more biometric sensors; and the second subsystem comprises a processor integrated circuit (IC) or a power management IC.

Item 11 is the hearing assistance device of item 1, wherein: the first subsystem comprises a 2.4 GHz radio; and the second subsystem comprises a processor integrated circuit (IC) embedded with a non-volatile memory IC.

Item 12 is the hearing assistance device of item 1, wherein: the first subsystem is configured for functional testing prior to being connected to the second subsystem; and the second subsystem is configured for functional testing prior to being connected to the first subsystem.

Item 13 is a hearing assistance device adapted for use in or on a wearer, the hearing assistance device comprising:

an enclosure; and a system in package (SIP) module disposed within the enclosure and comprising a radio subsystem and a digital signal processor (DSP) subsystem arranged in a vertically stacked configuration, the SIP module comprising:

a first substrate having a first surface and an opposing second surface, the second surface of the first substrate supporting the radio subsystem;

a second substrate comprising a plurality of flexible layers and having a first surface and an opposing second surface, wherein at least a DSP module of the DSP subsystem is embedded in the second substrate;

the second surfaces facing each other; and an interconnect layer separate from and bonded to and between the first and second substrates, the interconnect layer comprising a window and a region peripheral to the window, the window sized to accommodate at least the radio subsystem and the peripheral region comprising electrical pathways for electrically connecting the radio subsystem and the DSP subsystem.

Item 14 is the hearing assistance device of item 13, wherein a non-volatile memory integrated circuit (IC) is embedded in the second substrate and electrically coupled to the DSP module.

Item 15 is the hearing assistance device of item 14, wherein at least one of the flexible layers separates the DSP module and the memory IC.

Item 16 is the hearing assistance device of item 13, wherein: the first surface of the first substrate supports an antenna connection pad and one or more surface mount components coupled to the radio subsystem;

the second surface of the second substrate supports one or more surface mount components coupled to the DSP module;

the window of the interconnect layer is sized to accommodate the one or more surface mount components coupled to the radio subsystem and the one or more surface mount components coupled the DSP module; and the first surface of the second substrate comprises a plurality of spaced-apart electrical contacts for communicating with and powering the SIP module.

Item 17 is the hearing assistance device of item 13, wherein the radio subsystem comprises a 2.4 GHz radio integrated circuit.

Item 18 is the hearing assistance device of item 13, wherein the first substrate, the interconnect layer, and the second substrate define a vertically stacked structure.

Item 19 is the hearing assistance device of item 13, wherein the window is sized to provide clearance for components supported on one or both of the second surfaces of the first and second substrates.

Item 20 is a hearing assistance device adapted for use in or on a wearer, the hearing assistance device comprising:

an enclosure; and a system in package (SIP) module disposed within the enclosure, the SIP module comprising:

a first substrate having a first surface and an opposing second surface, the second surface of the first substrate supporting a radio subsystem;

a second substrate comprising a plurality of flexible layers and having a first surface and an opposing second surface;

a digital signal processor (DSP) subsystem embedded in the second substrate;

a non-volatile memory integrated circuit (IC) embedded in the second substrate and separated from the DSP subsystem by at least one of the flexible layers;

one or more surface mount components coupled to the DSP subsystem and supported by the second surface of the second substrate;

the second surfaces facing each other; and an interconnect layer separate from and bonded to and between the first and second substrates, the interconnect layer comprising a window and a region peripheral to the window, the window sized to accommodate the radio subsystem and the one or more surface mount components, and the peripheral region comprising electrical pathways for electrically connecting the radio subsystem and the DSP subsystem.

Although the subject matter has been described in language specific to structural features and/or methodological acts, it is to be understood that the subject matter defined in the appended claims is not necessarily limited to the specific features or acts described above. Rather, the specific features and acts described above are disclosed as representative forms of implementing the claims.

What is claimed is:

1. A hearing assistance device adapted for use in or on a wearer, the hearing assistance device comprising:

an enclosure; and a system in package (SIP) module disposed within the enclosure, the SIP module comprising:

a first substrate having a first surface and an opposing second surface, the first substrate supporting a first subsystem configured to perform a first function;

a second substrate having a first surface and an opposing second surface, the second substrate supporting a second subsystem configured to perform a second function different from the first function;

the second surfaces facing each other and at least one of the second surfaces supporting one or more components; and an interconnect layer bonded to and between the first and second substrates, the interconnect layer comprising a window and a region peripheral to the window, the window sized to accommodate the one or more components and the peripheral region comprising electrical pathways for electrically connecting the first subsystem and the second subsystem.

2. The hearing assistance device of claim 1, wherein the first substrate, the interconnect layer, and the second substrate define a vertically stacked structure.

3. The hearing assistance device of claim 1, wherein the window is sized to provide clearance for components supported on one or both of the second surfaces of the first and second substrates.

4. The hearing assistance device of claim 1, wherein each of the second surfaces supports one or more components.

5. The hearing assistance device of claim 1, wherein:

one of the first surfaces supports one or more components; and the other of the first surfaces comprises a plurality of spaced-apart electrical contacts for communicating with and powering the SIP module.

6. The hearing assistance device of claim 1, wherein at least one of the first and second substrates comprises a flexible substrate.

7. The hearing assistance device of claim 1, wherein:

the first substrate comprises a rigid substrate; and the second substrate comprises a flexible substrate.

8. The hearing assistance device of claim 1, wherein:

the second substrate comprises a plurality of flexible substrate layers;

the second subsystem comprises a first integrated circuit (IC) and a second IC; and the first and second ICs are separated by at least one of the flexible substrate layers.

9. The hearing assistance device of claim 8, wherein:

the first subsystem comprises a communications device;

the first IC of the second subsystem comprises a processor IC; and the second IC of the second subsystem comprises a memory IC.

10. The hearing assistance device of claim 1, wherein:

the first subsystem comprises a radio, a near-field magnetic induction (NFMI) device or one or more biometric sensors; and the second subsystem comprises a processor integrated circuit (IC) or a power management IC.

11. The hearing assistance device of claim 1, wherein:

the first subsystem comprises a 2.4 GHz radio; and the second subsystem comprises a processor integrated circuit (IC) embedded with a non-volatile memory IC.

12. The hearing assistance device of claim 1, wherein:

the first subsystem is configured for functional testing prior to being connected to the second subsystem; and the second subsystem is configured for functional testing prior to being connected to the first subsystem.

13. A hearing assistance device adapted for use in or on a wearer, the hearing assistance device comprising:

an enclosure; and a system in package (SIP) module disposed within the enclosure and comprising a radio subsystem and a digital signal processor (DSP) subsystem arranged in a vertically stacked configuration, the SIP module comprising:

a first substrate having a first surface and an opposing second surface, the second surface of the first substrate supporting the radio subsystem;

a second substrate comprising a plurality of flexible layers and having a first surface and an opposing second surface, wherein at least a DSP module of the DSP subsystem is embedded in the second substrate;

the second surfaces facing each other; and an interconnect layer bonded to and between the first and second substrates, the interconnect layer comprising a window and a region peripheral to the window, the window sized to accommodate at least the radio subsystem and the peripheral region comprising electrical pathways for electrically connecting the radio subsystem and the DSP subsystem.

14. The hearing assistance device of claim 13, wherein a non-volatile memory integrated circuit (IC) is embedded in the second substrate and electrically coupled to the DSP module.

15. The hearing assistance device of claim 14, wherein at least one of the flexible layers separates the DSP module and the memory IC.

16. The hearing assistance device of claim 13, wherein:

the first surface of the first substrate supports an antenna connection pad and one or more surface mount components coupled to the radio subsystem;

the second surface of the second substrate supports one or more surface mount components coupled to the DSP module;

the window of the interconnect layer is sized to accommodate the one or more surface mount components coupled to the radio subsystem and the one or more surface mount components coupled the DSP module; and the first surface of the second substrate comprises a plurality of spaced-apart electrical contacts for communicating with and powering the SIP module.

17. The hearing assistance device of claim 13, wherein the radio subsystem comprises a 2.4 GHz radio integrated circuit.

18. The hearing assistance device of claim 13, wherein the first substrate, the interconnect layer, and the second substrate define a vertically stacked structure.

19. The hearing assistance device of claim 13, wherein the window is sized to provide clearance for components supported on one or both of the second surfaces of the first and second substrates.

20. A hearing assistance device adapted for use in or on a wearer, the hearing assistance device comprising:

an enclosure; and a system in package (SIP) module disposed within the enclosure, the SIP module comprising:

a first substrate having a first surface and an opposing second surface, the second surface of the first substrate supporting a radio subsystem;

a second substrate comprising a plurality of flexible layers and having a first surface and an opposing second surface;

a digital signal processor (DSP) subsystem embedded in the second substrate;

a non-volatile memory integrated circuit (IC) embedded in the second substrate and separated from the DSP subsystem by at least one of the flexible layers;

one or more surface mount components coupled to the DSP subsystem and supported by the second surface of the second substrate;

the second surfaces facing each other; and an interconnect layer bonded to and between the first and second substrates, the interconnect layer comprising a window and a region peripheral to the window, the window sized to accommodate the radio subsystem and the one or more surface mount components, and the peripheral region comprising electrical pathways for electrically connecting the radio subsystem and the DSP subsystem.

* * * * *